United States Patent [19]

Stoffers et al.

[11] 4,094,325

[45] June 13, 1978

[54] METHOD AND APPARATUS FOR MAKING WRAPPERS FOR CIGAR BUNCHES

[75] Inventors: Helmut Stoffers, Geesthacht; Rudolf George, Hamburg, both of Germany

[73] Assignee: Hauni-Werke Korber & Co. KG, Hamburg, Germany

[21] Appl. No.: 715,693

[22] Filed: Aug. 19, 1976

[30] Foreign Application Priority Data

Sep. 2, 1975 Germany ..... 2538964

[51] Int. Cl.[2] ..... A24C 1/00; A24C 1/04

[52] U.S. Cl. ..... 131/21 R; 131/222; 131/140 R

[58] Field of Search ..... 131/122–132, 131/145, 146, 147 R, 147 A, 149, 33, 20 R, 21 R, 20 A, 36; 209/111.5, 117 T; 73/15 FD, DIG. 11

[56] References Cited

U.S. PATENT DOCUMENTS

| | | | |
|---|---|---|---|
| 557,647 | 1/1975 | Maas | 131/149 |
| 2,222,211 | 1/1973 | Klassier et al. | 209/111.6 |
| 3,770,112 | 11/1973 | Asfour | 131/146 |
| 4,018,674 | 4/1977 | Morris | 131/146 |

*Primary Examiner*—Robert W. Michell
*Assistant Examiner*—J. Millin
*Attorney, Agent, or Firm*—Peter K. Kontler

[57] ABSTRACT

Tobacco leaves are converted into wrappers for cigar bunches by removing the midribs from successive leaves, monitoring each of the thus obtained left-hand and right-hand leaf halves by a pair of photoelectric cells to determine whether the halves can yield one or more wrappers, and transferring the left-hand and right-hand halves to discrete first and second stamping stations where the halves are cut to yield wrappers which are automatically fed to the bunch wrapping unit or units of a cigar making machine.

27 Claims, 2 Drawing Figures

METHOD AND APPARATUS FOR MAKING WRAPPERS FOR CIGAR BUNCHES

BACKGROUND OF THE INVENTION

The present invention relates to a method and apparatus for manipulating tobacco leaves, and more particularly to a method and apparatus for converting tobacco leaves into wrappers which can be convoluted around cigar bunches, i.e., around the binders which surround the fillers of semifinished cigars. Still more particularly, the invention relates to improvements in a method and apparatus for removing wrappers from half leaves, i.e., from halves of destalked or destemmed tobacco leaves.

In accordance with the presently prevailing technique, automatic wrapper-rolling unit or units of a cigar making machine receive suitably configurated wrappers from one or more molds wherein cutting instrumentalities remove wrappers from half leaves. Such half leaves are obtained in response to removal of midribs or stems from whole tobacco leaves. Each half leaf is inspected by an attendant who flattens a satisfactory half leaf (i.e., a half leaf which can yield at least one wrapper) and places it into or onto the mold. The attendant then actuates the mechanism which removes a wrapper from the half leaf, and the wrapper is transferred from the mold into the automatic wrapping or rolling unit of the cigar making machine. The remnant of a half leaf which has already yielded a wrapper is inspected by the attendant and is placed back into or onto the mold if the attendant has decided that such remnant is large enough to yield a second warpper. As a rule, a half leaf will yield at least one satisfactory wrapper and, in some instances, two satisfactory wrappers.

A drawback of the just outlined conventional procedure is that the output of the cigar making machine depends on the skill and alertness of the attendant or attendants, i.e., the machine can be operated at maximum capacity only if the half leaves are inspected and placed into or onto the mold or molds by several attendants. Moreover, the inspection and manipulation of half leaves and/or remnants of half leaves is strenuous because it requires continuous concentration on the part of attendants. Still further, an unskilled or clumsy attendant is likely to waste substantial quantities of valuable material, either by placing a fresh half leaf into or onto the mold in such a way that the half leaf yields a single wrapper instead of two, or by failing to notice that the remnant of a half leaf (upon removal of a wrapper) is capable of yielding a further wrapper.

OBJECTS AND SUMMARY OF THE INVENTION

An object of the invention is to provide a novel and improved method of converting halves of destalked tobacco leaves into wrappers for cigar bunches or the like with a minimum of waste and at a rate which greatly exceeds the rate of production of wrappers in accordance with conventional procedures.

Another object of the invention is to provide an automatic method of converting halves of tobacco leaves into wrappers for cigar bunches or the like.

A further object of the invention is to provide a method of the above outlined character which renders it possible to increase the output of automatic cigar making machines simultaneously with substantial savings in manpower.

An additional object of the invention is to provide a method which is more economical than heretofore known methods of converting tobacco leaves into wrappers for cigar bunches.

Still another object of the invention is to provide a novel and improved apparatus for the practice of the above outlined method.

A further object of the invention is to provide an apparatus which can be installed in or combined with existing cigar making machines to increase the output of such machines by simultaneously reducing waste in tobacco which is used for the making of wrappers for cigar bunches.

An ancillary object of the invention is to provide the apparatus with novel and improved means for manipulating tobacco leaves, halves of tobacco leaves and wrappers for cigar bunches.

Another object of the invention is to provide the apparatus with novel and improved means for automatically determining the number of wrappers which can be obtained from halves of destemmed tobacco leaves.

One feature of the invention resides in the provision of a method of making wrappers for cigar bunches or the like. The method comprises the steps of monitoring the outlines of tobacco leaves (this step preferably includes comparing the outlines or dimensions of leaves with the dimensions or the outline of a satisfactory wrapper and producing signals when the comparing step indicates that a monitored leaf is capable of yielding at least one satisfactory wrapper), and utilizing the signals for the cutting (preferably stamping) of wrappers from the respective leaves.

The method preferably further comprises the step of removing the midribs or stems from successive whole tobacco leaves so that each whole leaf yields first and second leaf halves or half leaves. The monitoring step then includes separately monitoring the outline of each first and second half, and the signal utilizing step then preferably includes utilizing the signals which are respectively produced as a result of comparison of first and second halves for the cutting of respective halves at discrete first and second wrapper forming (stamping) stations.

The monitoring step preferably includes scanning several (i.e., at least two) spaced-apart portions of each half leaf. The monitoring step includes producing additional signals when the comparing step indicates that a monitored leaf or half leaf is capable of yielding several wrappers.

The method preferably further comprises the step of transporting a file of successive leaves in substantially identical orientation along a predetermined elongated path, and the monitoring step is preferably carried out in at least one predetermined portion of the path (i.e., in two discrete predetermined portions of the path if the monitoring step is preceded by removal of midribs from whole tobacco leaves). The just mentioned transporting step preferably includes moving the leaves stepwise, and the monitoring step is preferably carried out during intervals between successive movements of the leaves; alternatively, the signals which are produced as a result of monitoring can be used to interrupt the transporting step when a leaf or half leaf reaches an optimum position for transfer to the respective stamping station. During transport, successive leaves are preferably maintained at a predetermined distance from each other. As a rule, the distance between each pair of neighboring leaves will be the same.

The signal utilizing step (e.g., by resorting to a suitable control circuit) can include removing from the predetermined portion of the path each and every leaf (or each half leaf) which is capable of yielding at least one satisfactory wrapper, and the method preferably further comprises the step of advancing all other (unsatisfactory) leaves or halves beyond the predetermined portion of the path, i.e., the unsatisfactory leaves or halves are not transferred to a stamping or analogous wrapper removing station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
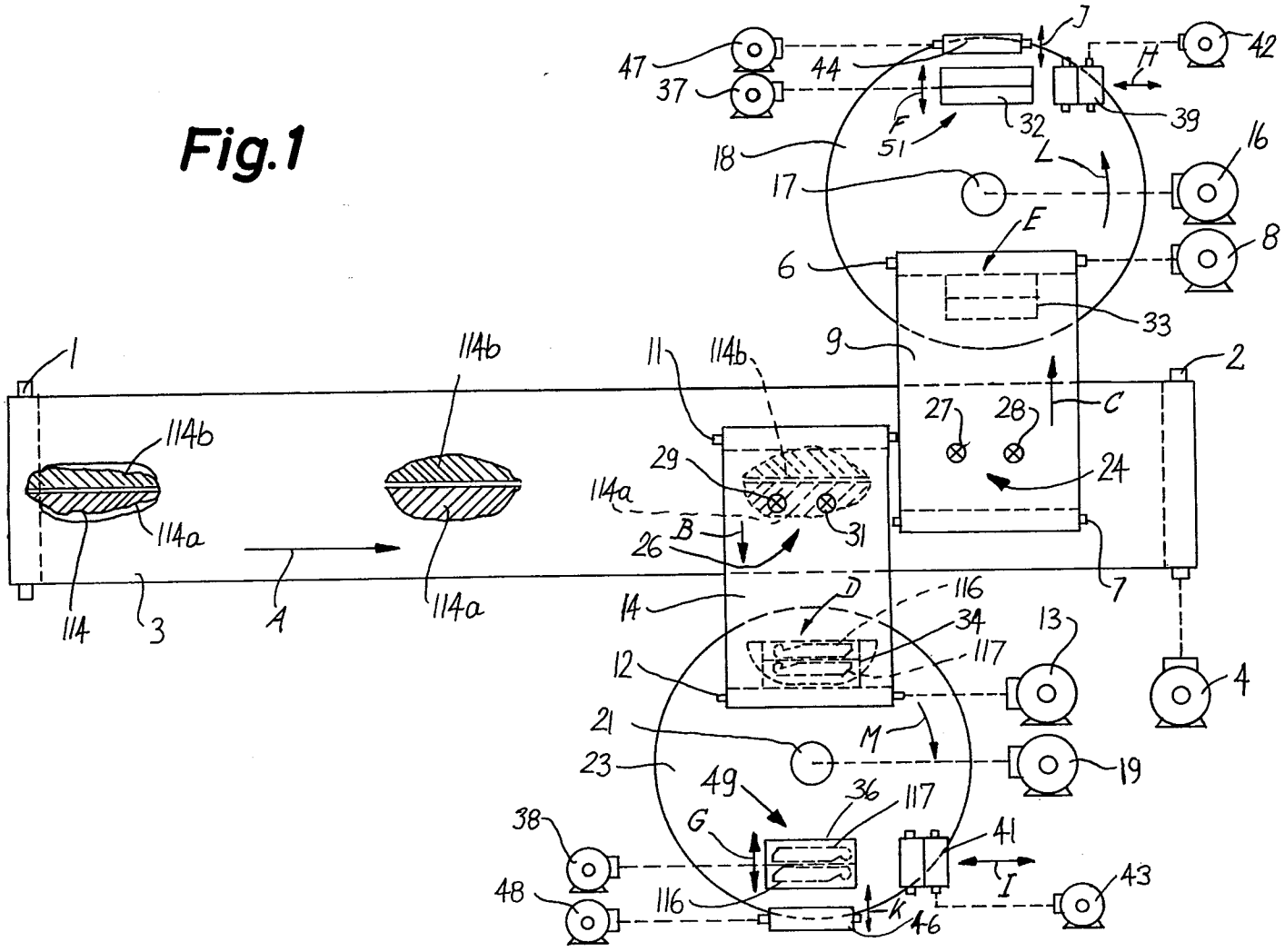
FIG. 1 is a schematic plan view of an apparatus which embodies the invention.

Referring to FIG. 1, there is shown an apparatus which comprises an elongated horizontal belt conveyor 3 which is trained over rollers 1, 2 and is driven by an intermittently operated prime mover 4, preferably an electric motor. The conveyor 3 constitutes a means for transporting half leaves or halves 114*a*, 114*b* of whole tobacco wrapper leaves 114 in the direction indicated by arrow A. The leaves 114 are relieved of midribs or stems and are placed onto the upper reach of the conveyor 3 at predetermined intervals and in a predetermined orientation.

When the motor 4 advances the conveyor 3 by two steps, the right-hand (lower) half 114*a* of the foremost tobacco leaf 114 is located below the lower reach of a second belt conveyor (front transverse conveyor) 14 which moves at right angles to the direction of movement of the conveyor 3 (see the arrow B) and is trained over rollers 11, 12. The roller 12 is driven by a second prime mover 13, preferably an electric motor. The conveyor 14 consists of light-transmitting material and its upper portion (as viewed in FIG. 1) is in line with a first monitoring device 26 including two detectors 29, 31 here shown as photoelectric cells. The photosensitive transducer of the cell 31 (which is located downstream of the cell 29, as viewed in the direction indicated by arrow A) serves to transmit signals which are used to effect stoppage of the motor 13; such signals are produced when a half leaf 114*a* interrupts the light beam between the light source and the transducer of the cell 31.

The second belt conveyor 14 is followed by a third belt conveyor (rear transverse conveyor) 9 the lower reach of which overlies the upper reach of the conveyor 3. The conveyor 9 also consists of light-transmitting material and is trained over rollers 6, 7. The roller 6 is driven by a third prime mover 8, preferably an electric motor, which can be started in response to signals from the photosensitive transducer of a photoelectric cell or detector 28 forming part of a second monitoring device 24 which further includes a photoelectric cell or detector 27. The distance between the cells 29, 27 or 31, 28 is half the distance between successive destemmed leaves 114 on the upper reach of the conveyor 3. The transducer of the cell 28 produces a signal when a half leaf 114*b* interrupts the light beam between the light source of the cell 28 and the respective transducer.

The lower reach of the conveyor 14 (which is foraminous) travels below the open underside of a suction chamber (not shown) which attracts the half leaf 114*a* to the underside of the lower reach of the conveyor 14 when such half leaf reaches the broken-line position of FIG. 1. The conveyor 14 transports the half leaf 114*a* to a station D above the upper surface of a rotary conveyor 23 here shown as a turntable mounted on a vertical shaft 21 which can be driven by a prime mover 19, preferably an electric motor. The construction of the conveyor 9 (the lower reach of which moves in the direction indicated by arrow C) is preferably identical to that of the conveyor 14. This conveyor can transport half leaves 114*b* to a station E above the upper surface of a rotary conveyor or turntable 18 mounted on a vertical shaft 17 which is driven by an electric motor 16.

The material of the conveyor 3 also transmits light so that the light sources of the detectors or cells 29, 31, 27, 28 can be mounted at a level above the conveyors 14, 9 and the associated transducers can be mounted at a level below the conveyor 3, or vice versa. The rotary conveyors or turntables 18, 23 respectively support cutting tools or molds 32, 33 and 34, 36 which are respectively overlapped by the half leaves 114*b*, 114*a* during removal or separation of wrappers therefrom (two wrappers 116, 117 are shown (twice) in the lower part of FIG. 1). Each cutting tool or mold is preferably movable relative to the respective turntable, most preferably in several directions. FIG. 1 merely shows a single electric motor 37 which can move the mold 32 in directions indicated by a double-headed arrow F, and a single motor 38 which can move the mold 36 in directions indicated by a double-headed arrow G.

The molds 32, 33, 34 and 36 are provided with cutting edges which are overlapped by the respective half leaves 114*b*, 114*a* prior to removal of wrappers. The means for effecting the separation includes counterknives in the form of rollers which are movable above the adjacent molds to thus cause the cutting edges to penetrate into the half leaves and to remove wrappers of predetermined size and shape. FIG. 1 shows two roller-shaped counterknives 39 which are movable in directions indicated by a double-headed arrow H in response to starting of an actuating means here shown as a prime mover 42, preferably a reversible electric motor. A similar actuating means or motor 43 drives the roller-shaped counterknives 41 which cooperate with the mold at a stamping or wrapper forming station 49. The directions in which the counterknives 41 are movable by the motor 43 are indicated by a double-head arrow I. The stamping or wrapper forming station which includes the counterknives 39 is shown at 51.

The apparatus of FIG. 1 further comprises two wrapper removing devices here shown as rollers 44, 46 which are respectively movable by reversible electric motors 47, 48 (see the double-headed arrows J and K). The rollers 44, 46 attract finished wrappers by suction and serve to transfer such wrappers to further processing stations, not shown, preferably to stations where the wrappers are convoluted around bunches each including a tobacco filler and a binder.

The directions in which the turntables 18, 23 are rotatable by their motors 16, 19 are respectively indicated by arrows L and M. The molds 32, 33, 34 and 36 are provided with suction ports (not shown) which attract the half leaves and wrappers during certain stages of operation of the apparatus.

Figure 2:
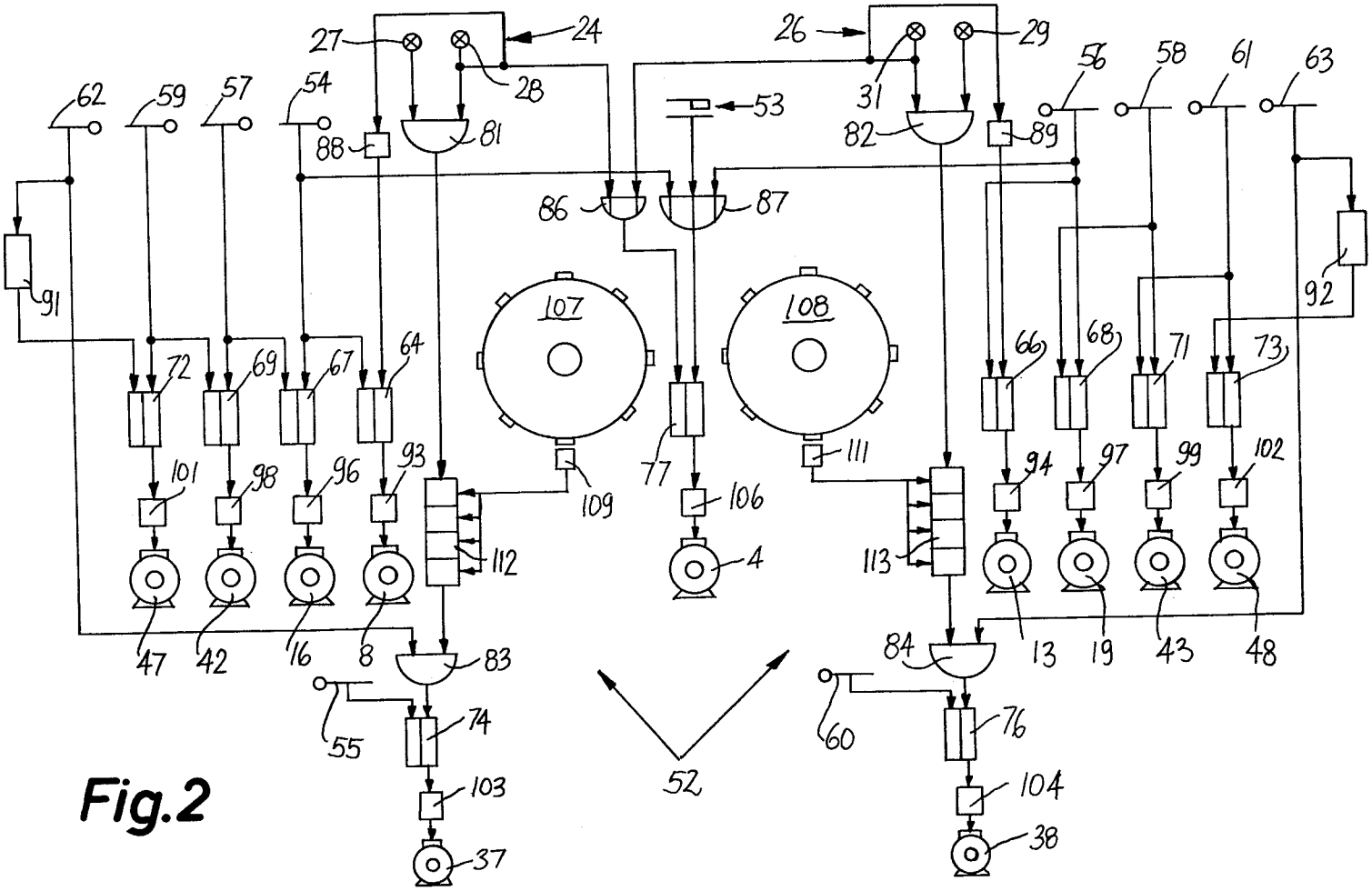
FIG. 2 is a circuit diagram of the control means for the apparatus of FIG. 1.

FIG. 2 shows a control circuit 52 which serves to synchronize the movements of conveyors 3, 9, 14 with movements of turntables 18, 23 and with the operation of stamping instrumentalities at the stations 49 and 51. The control circuit 52 comprises a manually operated switch 53 which constitutes a means for starting the motor 4 for the conveyor 3; limit switches 54 to 63 which can be actuated by conveyors 9, 14, turntables 18, 23, counterknives 39, 41, removing rollers 44, 46 and those molds which occupy positions shown in FIG. 1 as being occupied by the molds 32 and 36; signal storing circuits or storages 64, 66–69, 71–74 and 76–77; logic circuits including AND-gates 81 to 84 and OR-gates 86, 87; time-delay devices 88 and 89; counters 91, 92; amplifiers 93, 94, 96–99, 101 to 104 and 106; pulse generators or timers 107, 108 with associated proximity switches 109 111; and two additional time-delay devices 112, 113 in the form of shift registers. In addition, the control circuit 52 includes the aforementioned monitoring devices 24 and 26. In addition to, or instead of, the photoelectric cells, the monitoring device 24 and/or 26 may comprise one or more different detectors, e.g., suitable pneumatic detectors including transducers which produce signals in response to detection of a leaf portion therebelow.

The two detectors of each of the monitoring devices 24, 26 are positioned in such a way that they detect the foremost and rearmost portions of an average half leaf **114*a* or 114*b***. If the monitoring devices comprise three or more detectors each, the additional detectors can scan the half leaves intermediate their foremost and rearmost portions. This insures an even more accurate determination of the dimensions and/or outline of the respective half leaves.

The orientation of leaves 114 on the conveyor 3 is such that the substantially straight marginal portions (which were adjacent to the removed midribs) of the half leaves **114*a*, 114*b* extend in the longitudinal direction of the conveyor 3**.

The operation:

As mentioned above, the distance between the monitoring devices 24, 26 is half the distance between successive destemmed and properly oriented tobacco leaves 114 on the conveyor 3. It will be readily understood, however, that the distance between successive leaves 114 can be changed; this would merely entail certain modifications of the control circuit 52.

Successive tobacco leaves 114 can be placed onto the upper reach of the conveyor 3 prior or subsequent to removal of midribs or stems, and such leaves are thereupon smoothed so that their halves **114*a*, 114*b* lie substantially flat against the upper reach of the conveyor 3. The latter may be provided with markers resembling the outlines of leaves 114 to facilitate proper positioning of successive leaves. The conveyor 3 may be much longer than shown so as to enable two or more persons (or automatic feeding means) to place leaves 114 onto the upper reach upstream of the front transverse conveyor 14. The manner of and means for removing stems from the leaves 114** are well known in the art of cigar making.

The motor 4 for the conveyor 3 is started in response to closing of the electric switch 53 which causes the OR-gate 87 to transmit a signal to the right-hand (setting) input of the storage 77. The output of the storage 77 then transmits a signal to amplifier 106 which connects the motor 4 with a source of electrical energy, not shown. When the half **114*a* of the foremost tobacco leaf 114 moves between the light source and the transducer of the photoelectric cell 31, it interrupts the light beam which issues from the light source and causes the transducer to transmit a signal to the OR-gate 86 which, in turn, transmits a signal to the left-hand (erasing) input of the storage 77. The signal at the output of the storage 77 disappears so that the motor 4** comes to a halt.

The signal from the transducer of the cell 31 is further transmitted to the left-hand input of the AND-gate 82. If the right-hand half **114*a* of the foremost leaf 114 also interrupts the light beam between the light source and the transducer of the front cell 29 of the monitoring device 26, the transducer of the cell 29 transmits a signal to the right-hand input of the AND-gate 82 so that the output of the gate 82 transmits a signal to the first stage of the shift register 113. Simultaneous interruption of light beams which issue from the light sources of the cells 29, 31 by one and the same half leaf 114*a* indicates that such leaf is large enough to yield at least one wrapper (normally two wrappers). The signal which is transmitted to the first stage of the shift register 113 is caused to advance from stage to stage in response to pulses furnished by the proximity switch 111 which is actuated by the timer 108. The latter is rotated in synchronism with movements of the conveyor 3**.

If the transducer of the cell 31 transmits a signal to the left-hand input of the AND-gate 82 but the right-hand input of the gate 82 fails to receive a signal from the transducer of the cell 29, the half leaf **114*a* which is monitored by the device 26** is too small to yield two wrappers.

The signal which is furnished by the transducer of the cell 31 is further transmitted to the input of the time-delay device 89 whose output transmits a signal (with a preselected delay) to the right-hand (setting) input of the storage 66. The output of the storage 66 then transmits a signal to the amplifier 94 which starts the motor 13 for the front transverse conveyor 14. The half leaf **114*a* adheres to the underside of the lower reach of the conveyor 14 and is transported in the direction indicated by arrow B, i.e., toward the station D which accommodates the mold 34. The conveyor 14 carries or moves with a trip (not specifically shown) which actuates the limit switch 56 at the exact moment when the half leaf 114*a* overlies the mold 34 on the turntable 23. The limit switch 56 transmits a signal to the left-hand (erasing) input of the storage 66 whereby the signal at the output of the storage 66 disappears and the amplifier 94 arrests the motor 13 for the conveyor 14. The signal which is produced on actuation of the limit switch 56 is further transmitted to the right-hand (setting) input of the storage 68 so that the output of the storage 68 transmits a signal which causes the amplifier 97 to start the motor 19. The motor 19 begins to rotate the turntable 23 in a clockwise direction (see the arrow M in FIG. 1). Still further, the signal from the limit switch 56 is transmitted to the OR-gate 87 which causes the storage 77 to transmit a signal to the amplifier 106 whereby the latter starts the motor 4 for the conveyor 3**.

As mentioned above, the mold 34 is formed with suction ports which attract the half leaf **114*a* while the turntable 23 rotates through 180° to move the mold 34 (with a half leaf** 114*a* thereon) to the stamping station 49. The movement of turntable 23 is terminated when the turntable (or a trip which moves therewith) actuates the limit switch 58 which transmits a signal to the left-hand (erasing) input of the storage 68. The signal at the output of the storage 68 disappears and the amplifier 97 disconnects the motor 19 from the energy source.

Since the motor 4 is on, the conveyor 3 transports the foremost half leaf 114*b* toward the rear transverse conveyor 9. The motor 4 is arrested again when the half leaf 114*b* interrupts the light beam between the light source and the transducer of the photoelectric cell 28. The transducer of the cell 28 then transmits a signal to the OR-gate 86 which transmits a signal to the erasing input of the storage 77 so that the amplifier 106 disconnects the motor 4 from the energy source. If the foremost half leaf 114*b* simultaneously interrupts the light beam between the light source and the transducer of the photoelectric cell 27, the foremost half 114*b* is large enough to yield at least one satisfactory wrapper (normally two wrappers). When the signal from the transducer of the cell 28 effects a stoppage of the motor 4, the next half leaf 114*a* is in register with the cells 29, 31 of the front monitoring device 26.

The signal from the transducer of the cell 28 is further transmitted to the right-hand input of the AND-gate 81. If the half leaf 114*b* is large enough to simultaneously interrupt the light beam between the light source and the transducer of the cell 27, the transducer of the cell 27 transmits a signal to the left-hand input of the AND-gate 81 whose output transmits a signal to the first stage of the shift register 112. Such signal is transported from stage to stage of the shift register 112 in response to signals which are supplied by the proximity switch 109 in cooperation with the timer 107. The signal from the transducer of the cell 28 is also transmitted to the input of the time-delay device 88 whose output transmits a signal (with a preselected delay) to the right-hand (setting) input of the storage 64. The output of this storage transmits a signal to the amplifier 93 which starts the motor 8 for the conveyor 9 whereby the lower reach of conveyor 9 moves the foremost half leaf 114*b* off the conveyor 3 and to the station E where the half leaf 114*b* is accepted and attracted by the mold 33.

The signal which is furnished by the limit switch 58 (actuated by the turntable 23) is further transmitted to the right-hand (setting) input of the storage 71 whose output causes the amplifier 99 to start the motor 43 for the roller-shaped counterknives 41. These counterknives roll over the half leaf 114*a* on the mold 34 (which is then located at the stamping station 49) and cooperate with the cutting edges of the mold 34 to remove from the half leaf 114*a* two discrete wrappers 116, 117. The counterknives 41 actuate the limit switch 61 when they return to the retracted or inoperative positions of FIG. 1 whereby the switch 61 transmits a signal to the left-hand (erasing) input of the storage 71 to stop the motor 43; this can take place simultaneously with stoppage of the motor 8 for the conveyor 9 in response to a signal from the limit switch 54 which is actuated by the conveyor 9 or by a trip which moves in synchronism with this conveyor. The manner in which the limit switch 54 arrests the motor 8 is as follows: The left-hand (erasing) input of the storage 64 receives a signal on actuation of the limit switch 54 whereby the amplifier 93 arrests the motor 8. At the same time, the limit switch 54 transmits a signal to the right-hand (setting) input of the storage 67 whose output transmits a signal to the amplifier 96 which starts the motor 16 so that the latter rotates the turntable 17 through 180° and the mold 33 transfers the half leaf 114*b* (which is attracted thereto by suction) to the stamping station 51. The signal which is generated on actuation of the limit switch 54 is further transmitted to the OR-gate 87 which causes the storage 77 and amplifier 106 to start the motor 4 for the conveyor 3.

The signal which is generated on actuation of the limit switch 61 by the counterknives 41 is further transmitted to the right-hand (setting) input of the storage 73 whereby the signal from the output of the storage 73 causes the amplifier 102 to start the motor 48 for the removing roller 46. The roller 48 moves to the stamping station 49 and accepts the nearest freshly formed wrapper 116. The motor 48 thereupon moves the roller 46 back to the position shown in FIG. 1 (or beyond such position) so that the wrapper 116 is transferred to a further processing station, preferably to a station where the wrapper 116 is rolled around a cigar bunch to form the outer envelope of the resulting cigar. When the roller 46 returns to the position of FIG. 1, it actuates the limit switch 63 which causes the transmission of a signal to the right-hand input of the AND-gate 84. This takes place when the motor 4 for the conveyor 3 is arrested again in response to transport of the next-following half leaf 114*a* into the range of the monitoring device 26, i.e., when the transducer of the cell 31 has transmitted a signal to the OR-gate 86 and thence to the erasing input of the storage 77. If the monitoring device 26 has caused the AND-gate 82 to transmit a signal to the first stage of the shift register 113 in response to arrival of the foremost half leaf 114*a* at the respective monitoring station (i.e., if the foremost half leaf 114*a* was large enough to yield two discrete wrappers 116, 117), the signal which is transmitted by the limit switch 63 to the right-hand input of the OR-gate 84 arrives simultaneously with a signal from the last stage of the shift register 113. The output of the OR-gate 84 then transmits a signal to the right-hand (setting) input of the storage 76 which causes the amplifier 104 to start the motor 38 which moves the mold 34 at the stamping station 49 into the range of the removing roller 46. The latter is caused to complete a second forward and return stroke and accepts the second wrapper 117 from the mold 34 (which is then located at a level below the mold 36, as viewed in FIG. 1, because the motor 38 has moved the mold 34 radially at and away from the shaft 21).

If the transducer of the cell 29 failed to transmit a signal to the AND-gate 82 simultaneously with a signal from the transducer of the cell 31, the shift register 113 does not receive a signal and the AND-gate 82 does not transmit a signal (to the storage 76) when this gate receives a signal from the limit switch 63. This means that the motor 38 is not started and the roller 46 removes only one wrapper (116). The roller 46 performs a second forward and return stroke but to no avail because it cannot reach that portion of the mold 34 which would have supported a second wrapper 117. During the second forward and return stroke of the roller 46 (regardless of the presence or absence of a wrapper 117), the transducer of the cell 31 again transmits a signal which results in starting of the motor 13 for the conveyor 14 so that the next-following half leaf 114*a* is transferred to the station D.

The removing roller 46 causes the limit switch 63 to transmit two signals (i.e., a first signal when the roller 46 completes its first return stroke to remove the wrapper 116 and a second signal when the roller 46 completes its second return stroke to remove the wrapper 117, if any). Each such signal is registered by the counter 92, and the latter produces a signal in response to each second signal from the limit switch 63. The signal from counter 92 is transmitted to the erasing input of the storage 73 which causes the amplifier 102 to arrest the motor 48 for the removing roller 46.

The limit switch 60 is actuated by the mold 34 when the latter returns to the position corresponding to the position of mold 36 shown in FIG. 1 (i.e., when the motor 38 has caused the mold to complete an outward and a next-following inward stroke with respect to the axis of the shaft 21). The signal which is generated on actuation of the limit switch 60 is transmitted to the erasing input of the storage 76 which causes the amplifier 104 to arrest the motor 38. At such time, the next half leaf 114*a* is already located at a level above the turntable 23, i.e., the limit switch 56 was actuated by the conveyor 14 to arrest the motor 13 and to start the motor 19 for the turntable 23. Consequently, the mold 36 transfers the half leaf 114*a* from the station D to the stamping station 49. The treatment of such half leaf 114*a* then proceeds in the same way as described above for the half 114*a* of the foremost leaf 114.

The manner in which the half leaves 114*b* are treated on the turntable 18 is analogous to treatment of half leaves 114*a* on the turntable 23. Therefore, the function of limit switches 54, 55, 57, 59 and 62 (and of associated storages, amplifiers and other components) will not be described.

It will be understood that each of the two monitoring devices 24, 26 may comprise three or more photoelectric cells or analogous detectors. If each monitoring device comprises two cells, the light sources of such cells preferably direct light beams against spaced-apart portions of the half leaf 114*a* or 114*b* which is located at the respective monitoring station. Also, such light beams are preferably directed against marginal portions of the half leaves. This insures a more reliable determination whether or not a half leaf can yield more than one full-sized wrapper.

The mounting of cells 27, 28 and 29, 31 is such that these cells actually "compare" the outline of a half leaf 114*a* or 114*b* with the outline of a satisfactory wrapper. In other words, the monitoring by the devices 24, 26 involves a comparison of half leaves 114*a*, 114*b* with an imaginary (satisfactory) wrapper whose dimensions are acceptable for conversion into the outer envelope of a cigar. The signals which are furnished by the detectors of the monitoring devices 24, 26 are used by the control circuit 52 to effect the cutting (stamping) of wrappers 117 and/or 116 from the respective half leaves.

A half leaf 114*a* or 114*b* which is not acceptable (especially a half leaf which is too small so that it cannot be detected by the cells 27, 28, 29 or 31) simply advances beyond the transverse conveyors 14, 9 along the path which is defined by the upper reach of the conveyor 3 and descends into a collecting receptacle, not shown.

It is also within the purview of the invention to provide two discrete control circuits one of which includes the monitoring device 24 and the other of which includes the monitoring device 26. The illustrated control means is preferred at this time because it comprises a smaller number of component parts. Furthermore, it is also possible to monitor whole tobacco leaves 114 and to use a single stamping station at which a satisfactory whole leaf yields two, three or more wrappers.

An important advantage of the improved method and apparatus is that the number of attendants can be reduced without affecting the reliability of inspection of successive half leaves for availability of more than one wrapper. Thus, the number of attendants for each apparatus can be reduced by at least two persons, namely a first attendant who examines the left-hand half leaves and a second person who examines the right-hand halves of successive tobacco leaves in a conventional apparatus.

Another important advantage of the improved method and apparatus is that the determination of the number of satisfactory wrappers which can be obtained from successive half leaves is more reliable because such determination is not dependent on conscientiousness, skill and/or presence of attendants. Still further, the determination by monitoring means requires much less time than a visual inspection of each half leaf. Since the treatments which follow the monitoring of half leaves are (or can be) fully automatic, the output of a cigar making machine which embodies the improved apparatus is much higher than the output of a conventional machine wherein the half leaves are subjected to visual inspection. In fact, if the destalking of leaves 114 is performed automatically and if the placing of destalked leaves onto the conveyor is carried out by an automatic feeding device, the entire cigar making machine can operate continuously without necessitating any manual work.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

What is claimed is:

1. A method of making wrappers for cigar bunches or the like, comprising the steps of monitoring the outlines of tobacco leaves, including comparing the outlines of leaves with the outline of a satisfactory wrapper and producing signals when said comparing step indicates that a monitored leaf is capable of yielding at least one satisfactory wrapper; and utilizing said signals for the cutting of wrappers from the respective leaves.

2. A method as defined in claim 1, wherein said cutting includes stamping the wrappers out of the respective leaves.

3. A method as defined in claim 1, further comprising the step of removing the midribs from successive whole tobacco leaves so that each whole leaf yields first and second leaf halves, said monitoring step including separately monitoring the outline of each of said first and second halves.

4. A method as defined in claim 3, wherein said signal utilizing step includes utilizing the signals which are respectively produced as a result of comparison of said first and second halves for the cutting of respective halves at discrete first and second wrapper forming stations.

5. A method as defined in claim 3, wherein said monitoring step includes scanning several spaced-apart portions of each of said halves.

6. A method as defined in claim 5, wherein the number of scanned portions equals 2.

7. A method as defined in claim 1, wherein said monitoring step further includes producing additional signals when said comparing step indicates that a monitored leaf is capable of yielding several wrappers.

8. A method as defined in claim 7, wherein each of said leaves constitutes one half of a destemmed whole tobacco leaf.

9. A method as defined in claim 1, further comprising the step of transporting a file of successive leaves in substantially identical orientation along a predetermined elongated path, said monitoring step being carried out in at least one predetermined portion of said path.

10. A method as defined in claim 9, wherein said transporting step includes moving the leaves stepwise and said monitoring step is carried out, at least in part, in the course of stepwise movement of said leaves.

11. A method as defined in claim 9, wherein said transporting step comprises maintaining successive leaves of said file at a predetermined distance from each other.

12. A method as defined in claim 11, wherein said distance is the same for all leaves of said file.

13. A method as defined in claim 9, wherein said signal utilizing step includes removing from said predetermined portion of said path each leaf which is capable of yielding at least one satisfactory wrapper, and further comprising the step of advancing all other leaves beyond said predetermined portion of said path.

14. Apparatus for making wrappers for cigar bunches or the like, comprising means for monitoring tobacco leaves, including means for comparing the outlines of tobacco leaves with the outline of a satisfactory wrapper and for producing signals indicative of acceptable leaves which can yield satisfactory wrappers; means for cutting wrappers from acceptable leaves; and means for actuating said cutting means to remove wrappers from acceptable leaves in response to the respective signals.

15. Apparatus as defined in claim 14, further comprising control means which includes said monitoring and said actuating means.

16. Apparatus as defined in claim 14, wherein said cutting means comprises at least one cutting tool arranged to carry at least one wrapper and movable between first and second positions, means for moving said tool between said positions, and means for removing wrappers from said tool in one of said positions.

17. Apparatus as defined in claim 14 for making wrappers from paired first and second halves of destemmed tobacco leaves, wherein said monitoring means comprises discrete first and second detector means for respectively comparing the outlines of said first and second halves with the outline of a satisfactory wrapper.

18. Apparatus as defined in claim 17, wherein said cutting means comprises discrete first and second stamping units for said first and second halves and discrete first and second actuating means for said first and second stamping units, said first and second actuating means being respectively responsive to signals from said first and second detector means and further comprising first control means including said first detector means and said first actuating means and second control means including said second detector means and said second actuating means.

19. Apparatus as defined in claim 14, wherein said monitoring means comprises a plurality of detectors arranged to detect spaced-apart portions of tobacco leaves.

20. Apparatus as defined in claim 14, wherein said comparing and signal producing means includes photoelectric cells.

21. Apparatus as defined in claim 14, further comprising first conveyor means for transporting successive leaves into the range of said monitoring means and second conveyor means for transporting acceptable leaves from said first conveyor means to said cutting means.

22. Apparatus as defined in claim 21, wherein each of said conveyor means comprises a band conveyor.

23. Apparatus as defined in claim 21, wherein said cutting means comprises a first portion which receives leaves from said second conveyor means and a second portion actuatable by said actuating means, and further comprising third conveyor means supporting said first portion and movable between first and second positions in which said first portion is respectively adjacent to said second conveyor means and to said second portion.

24. Apparatus as defined in claim 23, wherein said third conveyor means is rotatable about a predetermined axis and said first and second positions are located substantially diametrically opposite each other with respect to said axis.

25. Apparatus as defined in claim 23, further comprising control means including said monitoring means and said actuating means and further including limit switches operable by said conveyors to initiate the sequence of movements performed by said conveyor means.

26. Apparatus as defined in claim 14 for making wrappers from first and second halves of destemmed tobacco leaves, wherein said monitoring means comprises discrete first and second detector means for respectively comparing the outlines of said first and second halves with the outline of a satisfactory wrapper and said cutting means defines discrete first and second stamping stations for said first and second halves, and further comprising first conveyor means for transporting first and second halves into the range of said first and second detector means, second conveyor means for removing acceptable first halves from said first conveyor means in the region of said first detector means, third conveyor means for removing acceptable second halves from said first conveyor means in the region of said second detector means, fourth conveyor means for transferring first halves from said second conveyor means to said first stamping station, and fifth conveyor means for transferring second halves from said third conveyor means to said second stamping station.

27. Apparatus as defined in claim 26, wherein at least one of said first, second and third conveyor means comprises an endless light-transmitting flexible element.

* * * * *